US008464559B2

(12) United States Patent
West et al.

(10) Patent No.: US 8,464,559 B2
(45) Date of Patent: Jun. 18, 2013

(54) FLIGHT ACCEPTABLE KNITTING NEEDLES

(75) Inventors: Gail West, Crescent City, CA (US); Ellery West, Crescent City, CA (US)

(73) Assignee: eg POP, Crescent City, CA (US)

( * ) Notice: Subject to any disclaimer, the term of this patent is extended or adjusted under 35 U.S.C. 154(b) by 12 days.

(21) Appl. No.: 13/208,208

(22) Filed: Aug. 11, 2011

(65) Prior Publication Data

US 2012/0036898 A1 Feb. 16, 2012

Related U.S. Application Data

(60) Provisional application No. 61/372,534, filed on Aug. 11, 2010.

(51) Int. Cl.
*D04B 3/02* (2006.01)

(52) U.S. Cl.
USPC ..... 66/117; 66/123

(58) Field of Classification Search
USPC ..... 66/116–118, 123, 1 R, 1 A
See application file for complete search history.

(56) References Cited

U.S. PATENT DOCUMENTS

| | | | | | |
|---|---|---|---|---|---|
| 229,402 | A | * | 6/1880 | Haff | 66/118 |
| 1,183,250 | A | * | 5/1916 | Smith | 66/117 |
| 1,254,161 | A | | 1/1918 | Sawyer | |
| 2,061,282 | A | * | 11/1936 | Leboff et al. | 66/117 |
| 2,075,621 | A | | 3/1937 | Miller | |
| 2,094,262 | A | | 9/1937 | Burnham | |
| 2,096,482 | A | * | 10/1937 | Cook et al. | 66/117 |
| 2,096,483 | A | * | 10/1937 | Cook | 66/117 |
| 2,208,124 | A | * | 7/1940 | Dunn | 66/117 |
| 2,246,254 | A | * | 6/1941 | Johnston | 66/118 |
| 2,807,945 | A | * | 10/1957 | Carlson | 66/117 |
| 3,927,538 | A | * | 12/1975 | Martella | 66/117 |
| 4,007,610 | A | * | 2/1977 | Linstead | 66/117 |
| 4,494,387 | A | * | 1/1985 | Phipps et al. | 66/117 |
| 4,553,410 | A | * | 11/1985 | Okada | 66/117 |
| 4,680,947 | A | * | 7/1987 | Phipps et al. | 66/117 |
| 4,846,351 | A | * | 7/1989 | Gardiner | 206/574 |
| 4,884,619 | A | | 12/1989 | Miyamura | |
| 6,254,425 | B1 | * | 7/2001 | Shchervinsky et al. | 439/502 |
| 6,904,773 | B1 | * | 6/2005 | Cushman | 66/1 A |
| 8,181,489 | B2 | * | 5/2012 | Selter | 66/117 |
| 8,210,003 | B2 | * | 7/2012 | Zheng | 66/117 |
| 2012/0036898 | A1 | * | 2/2012 | West et al. | 66/117 |

FOREIGN PATENT DOCUMENTS

| | | | |
|---|---|---|---|
| CA | 2689814 | | 7/2011 |
| WO | WO 2010102680 | A1 * | 9/2010 |
| WO | 2011/115415 | | 9/2011 |

* cited by examiner

*Primary Examiner* — Danny Worrell
(74) *Attorney, Agent, or Firm* — Fish & Associates, PC

(57) ABSTRACT

A knitting needle has multiple segments, at least one of which is relatively non-rigid, wherein the segments can be combined to produce a needle that is sufficiently rigid to be used for knitting, while also having diminished usefulness as a weapon. In three major classes of embodiments, one of the segments fits inside the other in a telescoping manner, one of the segments wraps around the other, or the two segments can fit together in some sort of slotted fashion. There may be one or more engineered points of structural failure. Segments can be held together frictionally, magnetically, threadably, using a snap or twist and lock fitting, or in any other suitable manner. Contemplated segments can have any suitable composition, including especially a bendable plastic or a foam rubber.

18 Claims, 6 Drawing Sheets

FLIGHT ACCEPTABLE KNITTING NEEDLES

PRIORITY CLAIM

This application claims priority to provisional patent application Ser. No. 61/372,534 filed Aug. 11, 2010.

FIELD OF THE INVENTION

The field of the invention is knitting needles technologies.

BACKGROUND

Modern air travel security sometimes restricts passengers from taking on board simple devices that allow them to pass the time engagingly. For example, knitting needles are prohibited on flights throughout countries in the European Union, and in the United States, the transportation airport security (TSA) officers can confiscate knitting needles at their discretion if they think the needles could be used as weapons.

One problem is that commonly used knitting needles, whether hollow or solid, tend to be quite rigid. For example, traditional bamboo, wooden, solid metal or plastic needles are all likely to be too rigid to pass muster under current TSA standards.

One could conceivably use multiple segments to solve the rigidity problem, but from the Applicants perspectives, none of the multiple segmented knitting needles solves that problem. For example, U.S. Pat. No. 2,094,262 to Burnham, describes a knitting needle shaft with a detachable point, but both the shaft and the detachable point are rigid, and would tend to be prohibited from use on airplanes.

It is also conceivable to hollow out the shaft to make it more flexible, but to date hollow shafted knitting needles tend to utilize the lumen in a manner that has nothing to do with rigidity. For example, U.S. Pat. No. 482,490 to Miller, describes a rigid crocheting needle with a hollow shaft adapted to fit a knitting needle within the hollow shaft. In Miller the addition of the second needle to the hollow compartment has no bearing on the functionality of the needle. The hollow compartment merely functions as a storage cavity. Even further, the outer (crocheting needle) is quite rigid.

Burnham and Miller and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

Thus, there is still a need for a knitting needle that has both flexible and rigid configurations.

SUMMARY OF THE INVENTION

The inventive subject matter provides apparatus, systems and methods in which a knitting needle has multiple segments, at least one of which is relatively non-rigid, wherein the segments can be combined to produce a needle that is sufficiently rigid to be used for knitting.

All suitable combinations of segments are contemplated. In three major classes of embodiments, one of the segments fits inside the other (e.g., in a telescoping manner), one of the segments wraps around the other, or the two segments can fit together in some sort of slotted fashion. The segments can be held together frictionally, magnetically, threadably, using a snap or twist and lock fitting, or in any other suitable manner. The desired additional rigidity for knitting can thus be accomplished by the segments mutually supporting each other, or by some other manner such as pneumatic pressure.

Contemplated segments can have any suitable composition, including especially a bendable plastic or a foam rubber. Most likely the outer surface of commercially suitable combinations will have a smooth coating, which can advantageously comprise at least one of an elastomeric polymer, a paint, a milk protein or a sugar cane protein.

Contemplated segments and coupling structures can advantageously include one or more engineered points of structural failure such that the needles can collapse or disassemble when they are pressed in a stabbing motion against a structure, as for example against a human.

Where a segment has an open end, that end can be closed by an end cap, or even by a cable that couples the open ends of two needles.

Various objects, features, aspects and advantages of the inventive subject matter will become more apparent from the following detailed description of preferred embodiments, along with the accompanying drawing figures in which like numerals represent like components.

DETAILED DESCRIPTION

Figure 1:
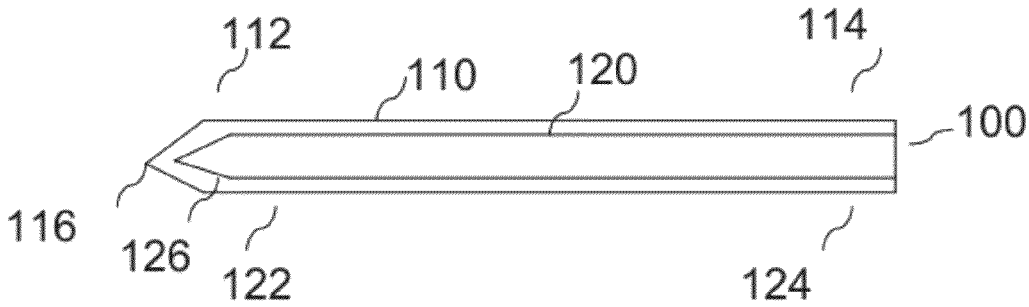
FIG. 1 is a side view of one embodiment of a knitting needle.

In FIG. 1, a multi-segmented knitting needle 100 generally comprises a non-rigid segment 110 and a second segment 120, which is preferably semi-rigid. The non-rigid segment 110 has a distal end 112 (distal because it tends to point somewhat away from the torso of the user) and a proximal end 114 (proximal because it tends to point somewhat away towards the torso of the user). A needle point 116 is disposed at the distal end 112. The second segment 120 can be non-rigid or semi-rigid, and is preferably constructed to support the non-rigid segment and to add to the rigidity of the knitting needle. In this particular example, the second segment 120 has a distal end 122 and a proximal end 124. A needle point 116 is disposed at the terminal end 122.

Figure 2:
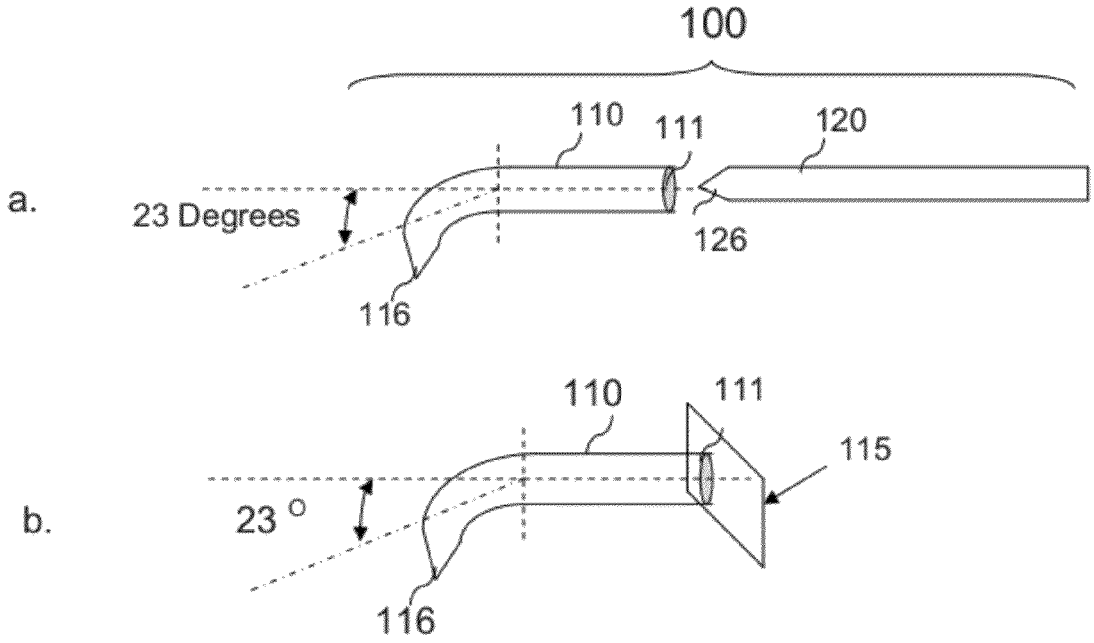
FIG. 2*a* is a side view of one preferred embodiment of the knitting needle of FIG. 1, comprising a flexible shealth and a foam rod.
FIG. 2*b* is a side view of the knitting needle of FIG. 2*a*, showing an angle of deflection when the needle is attached to a support.

In a preferred embodiment the non-rigid segment 110 is a flexible sheath having a lumen 111, and segment 120 is a foam rod that is configured to be slidably inserted into the first segment 110 to form the needle 100, as illustrated in FIG. 2*a*. In this embodiment segment 120 slides along the full length of the non-rigid segment 110.

As used herein, the term "non-rigid" as applied to a segment means that the segment has sufficient flexibility such that when one end is anchored horizontally to a fixed support, the opposite end can bend under its own weight by a deflection higher than 30°. More preferably the deflection angle is in the range of 20° to 30°. Even more preferably the deflection angle is in the range of 10° to 20°. In FIG. 2*b* segment 110 is non-rigid, since it bends under its own weight by approximately 23° when attached to support 115.

Contemplated non-rigid segments can be constructed from any suitable materials that allow sufficient flexibility for the structure being composed. Contemplated materials include natural and synthetic fibers, polymers or combination thereof (e.g., elastomers, epoxy resins, celluloids, urethanes, silicones, foam rubber, vulcanized rubber tubing, and bendable plastic). Contemplated structures include rolled paper, rolled paper impregnated with a natural polymer (e.g. natural latex) and/or a synthetic polymer (e.g. synthetic rubber), filaments, and molded, extruded or pultruded objects.

As used herein, the term "semi-rigid" as applied to a segment means that the segment has sufficient flexibility such that when one end is anchored horizontally to a fixed support, the opposite end will bend under its own weight by a deflection angle of 1° to 30°, inclusive. More preferably the deflection angle is in the range of 2° to 20° inclusive. Even more preferably the deflection angle is in the range of 5° to 10° inclusive.

A semi-rigid second segment that can be constructed from the same types of materials contemplated for the construction of the non-rigid segment. Additionally, the materials can be hardened to a degree that will result in the formation of a non-threatening needle. Material hardening techniques are known in the art. For example, foam rubber can be constructed to be flexible or stiff depending on the degree of cross-linkers used and the configuration of the cell structure. In another example, a bendable plastic can be hardened by curing with UV radiation. Yet in another example, the properties of vulcanized rubber are known to be influenced by details of the compounding of the base polymers, cross-linking agents, accelerators, fillers etc. The potential for "tailoring' the segment to a specific flexibility is essentially limitless.

It is contemplated that non-rigid and semi-rigid materials could be hardened to have a durometer number higher than 30 but lower than 90 on the A scale. More preferably, such materials could be hardened to have a durometer higher than 40 but lower than 60 on the A scale. For reference, the rubber band has durometer number of 25 and the ebonite rubber has a durometer number of 100, on the same scale. A break-away needle is preferably relatively rigid, with engineered break lines (i.e. engineered points of failure) that would tend to preclude the use of such a needle as a significant weapon. Where a needle according to aspects of the present inventive subject matter comprises a solid rubber without break lines, preferred needles would preferably have a relatively low durometer of no more than 25.

Durometer is one of several measures of the hardness of a material. Hardness can be defined as a material's resistance to permanent indentation. There are several scales of durometer, used for materials with different properties. The two most common scales, using slightly different measurement systems, are the ASTM D2240 type A and type D scales. The A scale is for softer plastics, while the D scale is for harder ones. However, the ASTM D2240-00 testing standard calls for a total of 12 scales, depending on the intended use; types A, B, C, D, DO, E, M, O, OO, OOO, OOO-S, and R. Each scale results in a value between 0 and 100, with higher values indicating a harder material As used herein, the term "rigid" as applied to a segment means that when one end is anchored horizontally to a fixed support, the opposite end will bend under its own weight by a deflection angle of less or equal to than 1°. A relatively rigid will have a deflection angle in the range of 1° to 5°. By way of example, commercially available needles are constructed from materials (e.g. casein, metal, and plastic) and in such manner that they are relatively rigid.

Contemplated segments can be hollow or solid. Such segments can be coated to impart a smooth surface suitable for knitting. Coating materials comprise natural polymers such that proteins, carbohydrates, natural latex, synthetic polymers such that elastomers, epoxy resins, celluloids, enamels, lacquers, urethanes, silicones, synthetic rubber, paint. For example a segment constructed out of rolled paper can be coated with at least one of a milk protein and a sugar cane protein. Another example is a segment constructed from vulcanized rubber that can be coated with a fine powder such as starch 318 shown in FIG. 3. Other contemplated coatings can be multi-component, i.e, they can be formed using at least two of the suitable coatings.

Figure 3:
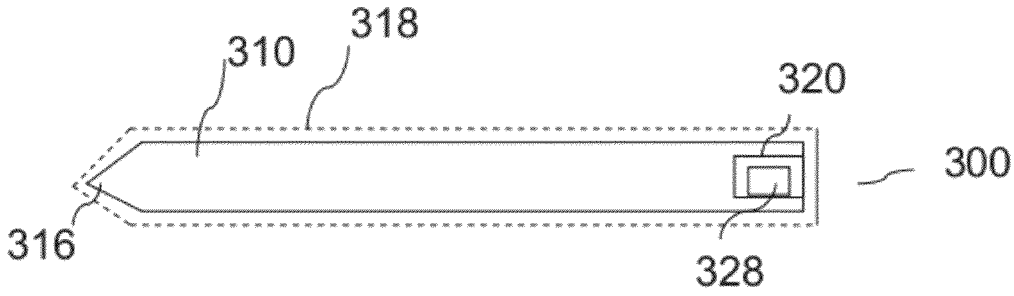
FIG. 3 is a side view of one embodiment of the knitting needle of FIG. 1, comprising a vulcanized rubber rod coated with starch.

In FIG. 3, the needle 300 comprises a non-rigid segment 310, a coating 318, a knitting tip 316 and a semi-rigid segment 320. In this embodiment, segment 320 is configured to slidably insert and fasten into a short section of the proximal end of the non-rigid segment 310. The second segment comprises a pneumatic device 328 that can introduce pressurized air to stiffen the non-rigid segment 310.

Figure 4:
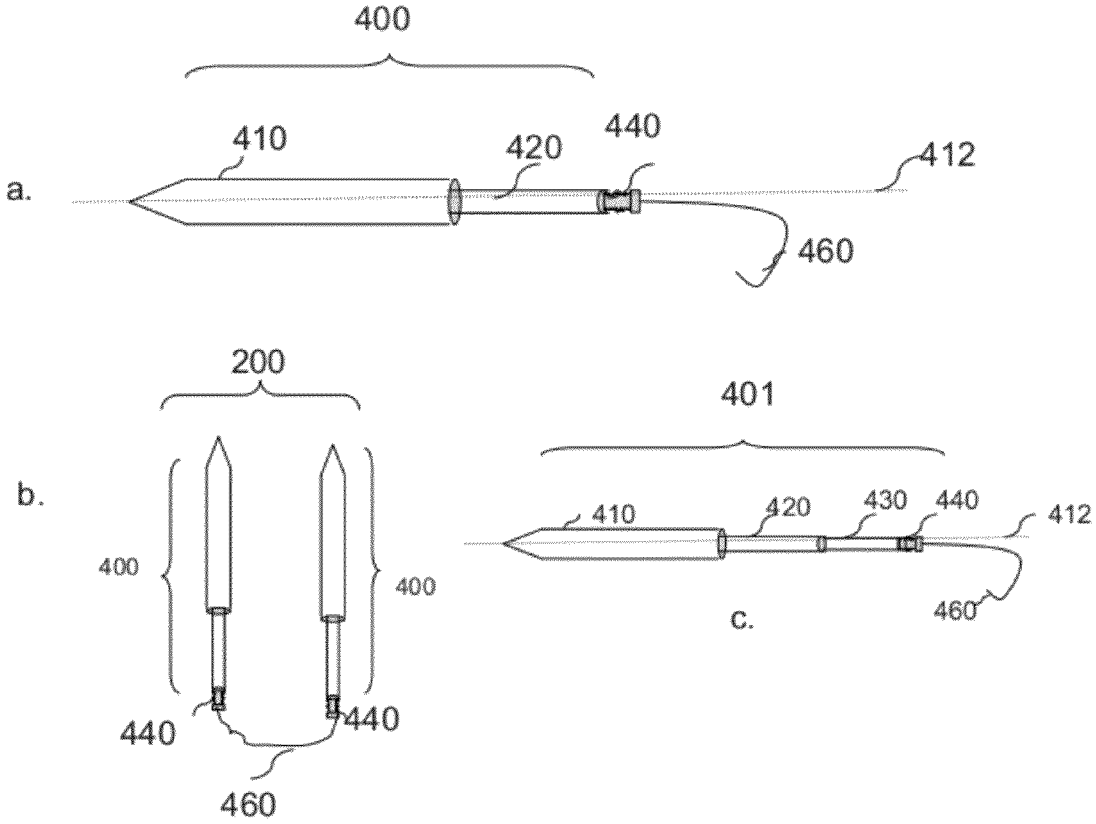
FIG. 4*a* is a side view of one embodiment of a telescopic knitting needle having two concentric segments.
FIG. 4*b* is a side view of two telescopic knitting needles coupled together for circular knitting.
FIG. 4*c* is a side view of one embodiment of a telescopic knitting needle having three concentric segments.

FIG. 4*a* generally comprises telescopically linked first and second segments 410, 420, and end cap 440, and an optional cable or other flexible member 460. As shown, first segment 410 is concentric about second segment 420, although all other suitable non-concentric telescoping arrangements are also contemplated. Here, both first and second segments are non-rigid, but their combination produces a semi-rigid knitting needle 400.

End cap 440 is secured at the proximal end of the second segment 420. Such cap can advantageously prevent stitches from slipping from the needle. The cap 440 is preferably constructed from a light weight material, as for example a durable plastic. The cap can advantageously have a blunt end similar to an eraser attached to the end of the pencil, and can be removably attached to the proximal end of the second segment 420 in any suitable manner (e.g., threaded, slided etc.)

Flexible member 460 is optional, and when present can be coupled to at least one of the end cap 440 and the proximal portion of the second segment 420. Contemplated flexible members include a plastic or other cable that can be used for circular knitting.

FIG. 4*b* represents a knitting system 200 where the needle 400 described in FIG. 4*a* is coupled to a second needle 400 using the flexible member 460. It can be appreciated that needles assembled in any of the contemplated configurations described herein, can be coupled in a similar manner to allow circular knitting.

In FIG. 4*c* the knitting needle 401 further comprises first and second segments described above, and a third segment 430 nested within, and configured to be telescoping relative to, the second segment. In this embodiment all three segments can be non-rigid, and the combination of the three segments can form a semi-rigid functional knitting needle. Furthermore, the additional nested segment 430 can cooperate to provide an adjustable length for the needle.

Figure 5:
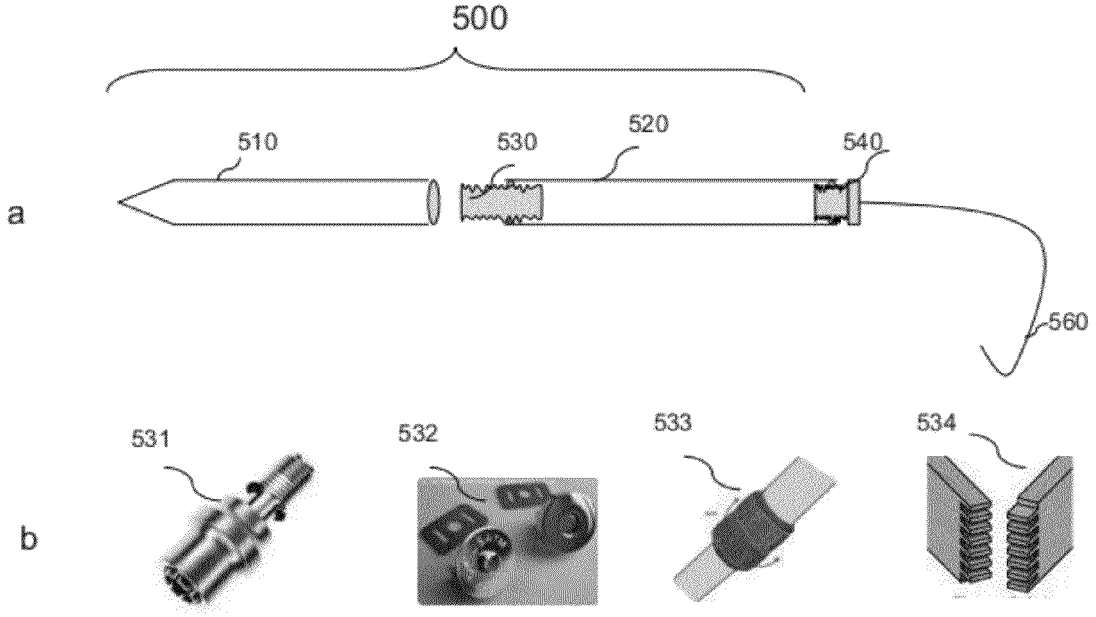
FIG. 5*a* is a side view of one embodiment of a knitting needle comprising two threadably coupled segments.
FIG. 5*b* shows various embodiments of coupling mechanisms for knitting needle segments.

FIG. 5*a* generally comprises threadably coupled first and second segments, 510, 520, a thread adaptor 530, an end cap 540, and an optional cable or other flexible member 560. In this embodiment, the first segment 510 is semi-rigid and the second 520 can be constructed from a non-rigid material that deforms when stabbed against a head or other portion of a body, yet have enough rigidity to manipulate the yarn. For example, the second segment 520 can be a rubber type pencil eraser with a coated surface to allow smooth knitting.

Contemplated segments can be held together frictionally, magnetically, threadably, adhesively, using a snap or twist and lock fitting, or in any other suitable manner that composes the functional needle. FIG. 5*b* illustrates some of these mechanisms, specifically a snap fitting 531, magnet 532, twist and lock mechanism 533, and finger joint mechanism 534.

Figure 6:
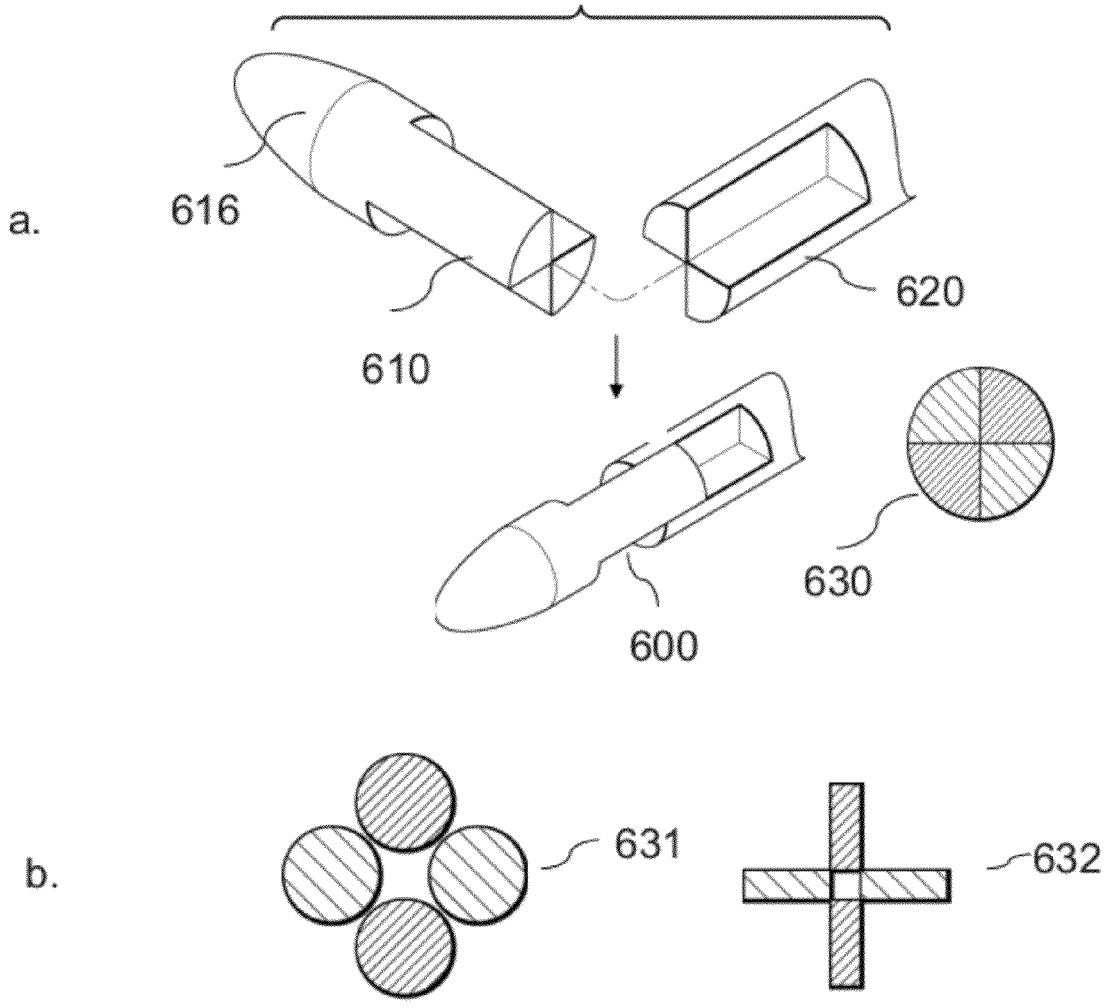
FIG. 6*a* shows perspective views of slotted knitting needle segments that mate in a finger joint fashion.
FIG. 6*b* shows cross sections for two alternative designs for slotted knitting needle segments.

In FIG. 6*a*, the two segments that form the needle 600 are slotted, and mate in a finger joint fashion. In that manner, segments 610 and 620 interlock lengthwise to form a cylindrical needle with a cross section 630. In this embodiment the two segments can both be non-rigid, or one non-rigid and the other semi-rigid. FIG. 6*b* depicts alternative designs having the cross sections 631, 632 shown.

Figure 7:
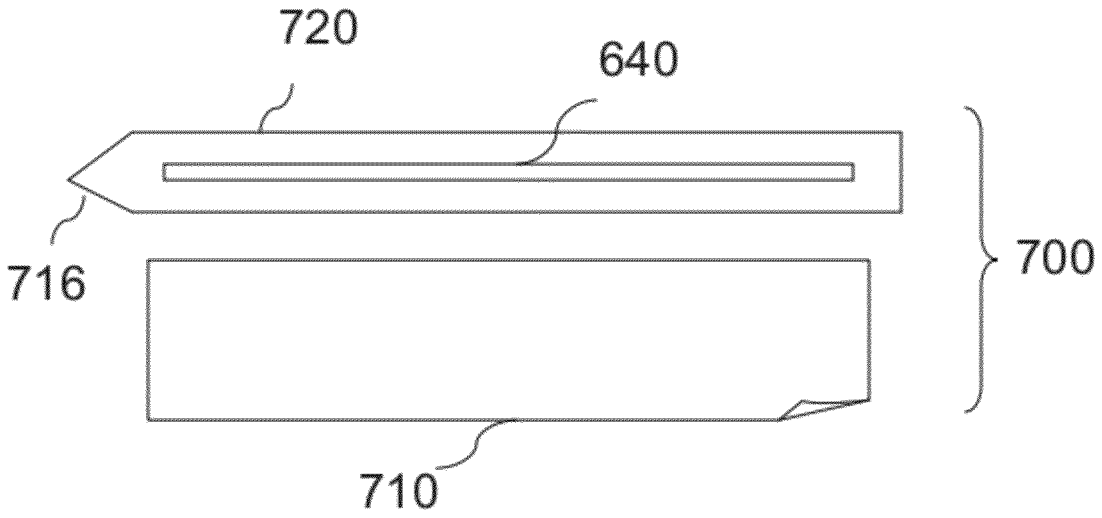
FIG. 7 is a side view of one embodiment of a knitting needle having a semi-rigid segment and a non-rigid segment.

Yet in another embodiment shown in FIG. 7, the second segment 720 has the knitting tip 716 disposed on the distal end. Here, segment 720 is semi-rigid and the first segment 710 is non-rigid and wrapped around the second segment to form the knitting needle 700. For example, the second segment can be a rubber pencil and the first segment can be coated paper. Furthermore the rubber pencil can have a longitudinal split 722 to allow insertion of a coated paper for rolling around the pencil to create a smooth surface.

Contemplated needles can advantageously include one or more engineered points of structural failure that allow the needles to collapse or disassemble when they are used in a stabbing motion against a solid or semi-solid structure, as for example against a human. All manner of commercially feasible points of structural failure are contemplated, including for example perforation and stress fractures.

Figure 8A:
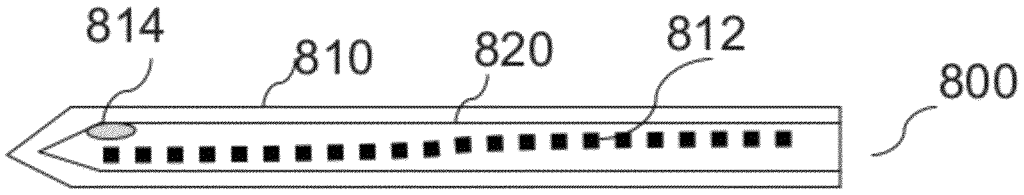
FIG. 8*a* is a side view of a knitting needle with engineered stress fractures and perforations.
Figure 8B:
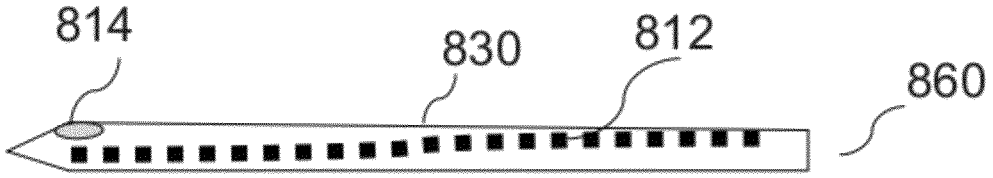
FIG. 8*b* is a side view of a break-away knitting needle with engineered stress fractures and perforations.

Such points of structural failure can be located in any suitable portion or portions of a needle, including in any one or more of the segments and/or coupling mechanisms. For example in FIG. 8*a*, the needle 800 generally comprises first and second segments 810 and 820 and engineered stress fractures 812 and engineered perforations 814 are longitudinally incorporated into the needle segment 820. In FIG. 8*b*, the break-away needle 860 comprises a shaft 830 having engineered stress fractures 812 and engineered perforations 814 incorporated into the shaft 830.

Figure 9:
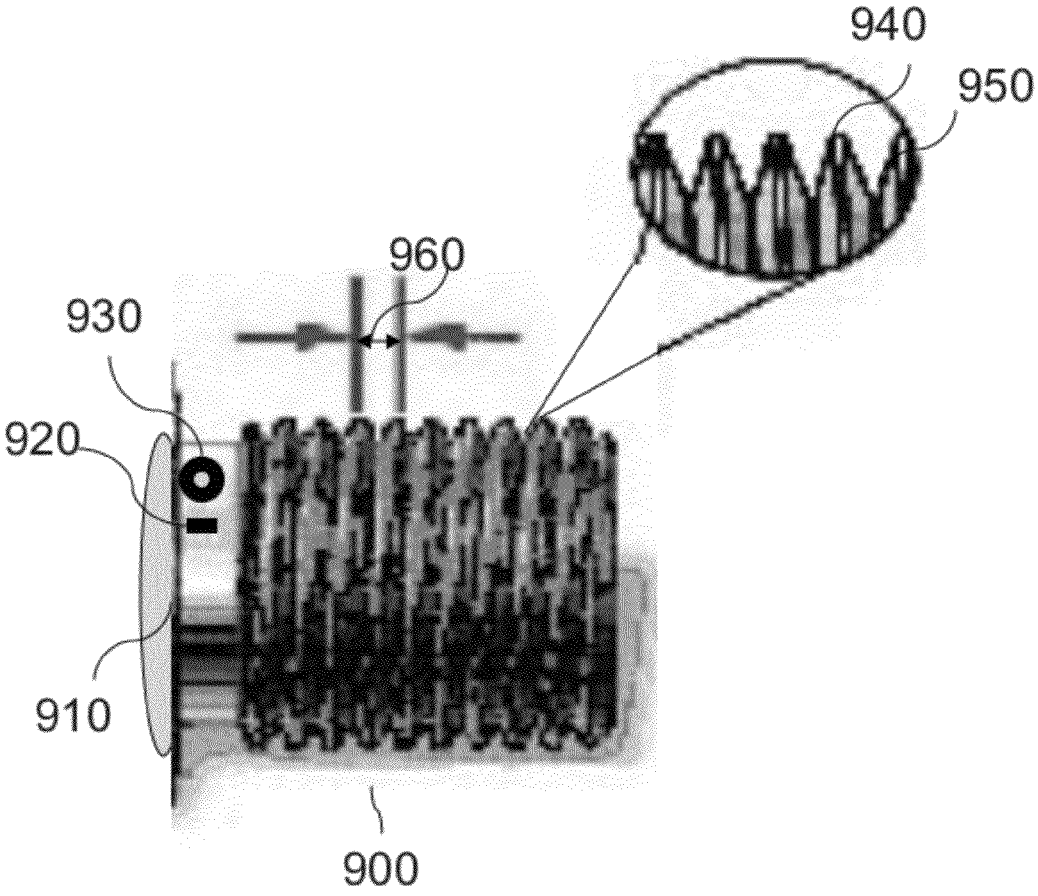
FIG. 9 is a perspective view of a male adaptor comprising a threaded shaft and having stress fractures and perforations.

FIG. 9 shows engineered points of structural failure, stress fractures 920 and perforations 930, that are disposed on a threaded shaft 910 used to couple adjacent needle segments. In this particular example the shaft is used in a male to male adaptor 900. Engineered points of structural failure can additionally or alternatively be introduced to weaken the coupling mechanism by intentionally altering the size of various components. For example, the distance between the top point of the thread, also known as the crest 940, and the bottom point of the thread, also known as the root 950, can be reduced, and/or the distance between adjacent threads, also known as the pitch 960, can be increased to create a weaker coupling between adjacent needle segments.

Needles having engineered points of failure can advantageously further include an identification label. An example of such an identification label is label 814 in FIG. 8. Preferred labels are brightly colored, or include a fluorescent dye or other chemical compound that allows for convenient detection by an inspector using an optical scanner.

Knitting needles can be of any suitable sizes and dimensions. For example the needle containing segment can have various diameters to enable large stitches that can be made with large needles, or have small diameters to fine knitting. For example the length can range from 10 to 40 cm, and the diameter can range from 1.5 to 25 mm. Needles can be interchangeable and knitting needles as described herein to include crochet needles.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps can be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A multi-segmented knitting needle, comprising:

a first non-rigid segment having a distal end and a proximal end;

a second segment having a distal end and a proximal end, wherein the second segment is configured to operatively interact with the first segment such that a combination of the first and second segments forms the needle; and wherein a knitting tip is disposed at the distal end of at least one of the first and second segments, and wherein multiple engineered stress fractures are disposed longitudinally along at least one of the first and second segments.

2. The needle of claim 1, wherein the first segment comprises a sheath having a lumen, and the second segment can be slidably inserted into the lumen.

3. The needle of claim 2, wherein the second segment cooperates with the first segment to provide pneumatic stiffness to the first segment.

4. The needle of claim 1, wherein at least one of the first and second segments comprises rolled paper having a coating.

5. The needle of claim 4, wherein the coating comprises at least one of a milk protein, a sugar cane protein an elastomeric polymer and a paint.

6. The needle of claim 1, wherein at least one of the first and second segments comprise at least one of a bendable plastic and foam rubber.

7. The needle of claim 1, wherein the second segment is nested within the first segment and configured to be telescoping relative to the first segment.

8. The needle of claim 7, further comprising a third segment is nested within the second segment and configured to be telescoping relative to the second segment.

9. The needle of claim 1, wherein the first segment is threadably coupled to the second segment.

10. The needle of claim 1, wherein the first segment is magnetically coupled to the second segment.

11. The needle of claim 1, wherein the first segment and the second segment are coupled by a snap fitting.

12. The needle of claim 1, wherein the first segment and the second segment are coupled by a twist and lock mechanism.

13. The needle of claim 1, wherein at least one of the first and second segments further comprises an end cap.

14. The needle of claim 1, further comprising a point of structural failure.

15. The needle of claim 1, wherein each of the first and second segments is slotted, and the first and second segments mate in a finger joint fashion.

16. The needle of claim 1, wherein the second segment is wrapped about the first segment.

17. A knitting system, comprising two of the needles of claim 1 coupled by a cable.

18. A break-away knitting needle, comprising:

a shaft having a knitting tip disposed on an end of the shaft; and wherein at least a portion of the shaft includes at least one engineered point of structural failure, and wherein multiple engineered stress fractures are disposed longitudinally along at least one of the first and second segments.

* * * * *